US006817164B2

(12) United States Patent
Mauffette et al.

(10) Patent No.: US 6,817,164 B2
(45) Date of Patent: Nov. 16, 2004

(54) APPARATUS FOR PACKING OBJECTS INTO AN ELONGATED TUBE

(75) Inventors: Claude Mauffette, Montréal (CA); Louis Lefebvre, Montréal (CA); Yan Tremblay, Montréal (CA)

(73) Assignee: Les Developpements Angelcare Inc., Ile des Soeurs (CA)

( * ) Notice: Subject to any disclaimer, the term of this patent is extended or adjusted under 35 U.S.C. 154(b) by 0 days.

(21) Appl. No.: 10/665,144

(22) Filed: Sep. 22, 2003

(65) Prior Publication Data

US 2004/0093837 A1 May 20, 2004

(30) Foreign Application Priority Data

Nov. 20, 2002 (CA) ..... 2412431

(51) Int. Cl.[7] ..... B65B 43/42; B65B 43/48

(52) U.S. Cl. ..... 53/576; 53/241; 53/258; 53/260; 53/551; 53/567

(58) Field of Search ..... 53/241, 258, 260, 53/551, 567, 576, 577; 220/4.26, 4.05, 262–264, 495.11

(56) References Cited

U.S. PATENT DOCUMENTS

| | | | | | |
|---|---|---|---|---|---|
| 3,452,368 | A | | 7/1969 | Couper | 4/142 |
| 3,595,507 | A | * | 7/1971 | Kurlander | 248/97 |
| 3,665,522 | A | * | 5/1972 | Backlund et al. | 4/484 |
| 3,908,336 | A | * | 9/1975 | Forslund | 53/576 |
| 4,081,105 | A | * | 3/1978 | Dagonnet et al. | 220/263 |
| 4,519,104 | A | | 5/1985 | Nilsson | 4/484 |
| 4,869,049 | A | * | 9/1989 | Richards et al. | 53/459 |
| 4,934,529 | A | | 6/1990 | Richards et al. | 206/303 |
| 5,125,526 | A | * | 6/1992 | Sumanis | 220/263 |
| 5,147,055 | A | * | 9/1992 | Samson et al. | 220/259.2 |
| 5,385,259 | A | * | 1/1995 | Bernstein et al. | 220/495.11 |
| 5,520,303 | A | * | 5/1996 | Bernstein et al. | 220/495.08 |
| 5,590,512 | A | * | 1/1997 | Richards et al. | 53/567 |
| 5,655,680 | A | * | 8/1997 | Asbach et al. | 220/495.11 |
| 5,765,339 | A | * | 6/1998 | Garland | 53/258 |
| 6,065,272 | A | * | 5/2000 | Lecomte | 53/576 |
| 6,128,890 | A | * | 10/2000 | Firth | 53/567 |
| 6,145,283 | A | * | 11/2000 | Noordenbos et al. | 53/554 |
| 6,170,240 | B1 | * | 1/2001 | Jacoby et al. | 53/567 |
| 6,199,714 | B1 | | 3/2001 | Thompson | 220/495.07 |
| 6,370,847 | B1 | * | 4/2002 | Jensen et al. | 53/459 |
| 6,516,588 | B2 | * | 2/2003 | Jensen et al. | 53/459 |
| 2002/0066261 | A1 | | 6/2002 | Richards | 53/574 |

FOREIGN PATENT DOCUMENTS

| | | |
|---|---|---|
| CA | 1298191 | 3/1992 |
| CA | 1318234 | 5/1993 |
| WO | 96/34553 A1 | 11/1996 |

* cited by examiner

*Primary Examiner*—Stephen F. Gerrity
*Assistant Examiner*—Hemant Desai
(74) *Attorney, Agent, or Firm*—Kubovcik & Kubovcik

(57) ABSTRACT

The invention relates to an apparatus for packaging objects, like soiled diapers, into an elongated flexible plastic tube. The apparatus includes a container with an upper portion with an opening and a lower portion. A cassette is mounted in the upper portion of the container coaxially with the opening to store a tube in a compacted form. A plunging device is provided to compress the object to be disposed of, and to push it into the tube and then to the bottom part of the container. The plunging device includes biased flaps and biased slides orthogonal to the arms which permits to push the object down while allowing a hermetic seal of the flexible tube to prevent escape of bad odours.

18 Claims, 3 Drawing Sheets

APPARATUS FOR PACKING OBJECTS INTO AN ELONGATED TUBE

FIELD OF THE INVENTION

The present invention relates to an apparatus for packaging objects to be disposed of into pouches formed along a tube of plastic material.

More specifically, the invention relates to an apparatus for use to package waste material like, for example, babies' disposable diapers, into a tube of flexible plastic material and to store the so packaged waste material in an hygienic and odor-free manner, until it is collected. However, it is worth mentioning that the invention is not exclusively restricted to the disposal of waste material and may actually be used for packaging any kind of objects to be disposed of.

BRIEF DESCRIPTION OF THE PRIOR ART

Apparatuses of the above-mentioned type for use to package a waste material in such a manner as to reduce to a maximum extent the escape of bad odors, are already known. By way of non-restrictive examples, reference can be made to U.S. Pat. No. 3,452,368 of 1969 (COUPER) and Canadian patent No. 1,298,191 of 1992 (RICHARDS et al).

These known apparatuses basically comprise a container having an open or openable upper portion in which the waste to be disposed of may be inserted and a bottom portion in which the disposed waste are stored. A ring-shaped cassette is mounted in the upper portion of the container, for use to store in a pleated form, a tube of flexible plastic material into which the waste material may be inserted and stored.

In use, the waste to be disposed of is inserted into the tube at the upper portion of the container and the tube and waste are then pushed through the open center of the cassette towards the bottom portion of the container for storage purpose. Means are also provided for closing the tube below the cassette and thus preventing bad odor from escaping from the tube during storage.

In Canadian patent No. 1,298,191, these means are disclosed as a core that can be turned by a lid about a cylinder in order to twist the tube at regular intervals to form successive "pouches" that are kept sealed while they are stored.

Also known in the art is Canadian laid-open application No. 2,383,799 which discloses an apparatus for packaging objects, especially used diapers or other waste material to be disposed of, into corresponding pouches formed along a tube made of a flexible plastic material. The apparatus comprises a container in the upper portion of which a ring-shaped cassette is mounted for storing the tube of flexible plastic material in a compacted form and allowing it to be pulled from the cassette and passed through the same towards the bottom portion of the container in order to receive and store the objects to be disposed while they are inserted into the upper portion of the container. A squeezing device is also mounted in the container below the cassette to pull the tube from the cassette and move it down together with the objects inserted into the container. This squeezing device comprises a pair of opposite rotatable members between which the tube is inserted. The rotatable members have a plurality of opposite bars extending transversely to the tube in order to squeeze this tube, keep it closed until other objects to be disposed of are inserted into the upper portion of the container, and pull it down to move the tube and the objects contained therein towards the bottom portion of the container for storage purpose. Actuation of the rotatable members in unison and in opposite direction to achieve the requested squeezing, closing and pulling down of the tube is preferably obtained by actuation of a closure lid that is part of the container.

SUMMARY OF THE INVENTION

The object of the present invention is to provide an apparatus of the above-mentioned type, which includes a simple mechanism for ensuring that the objects to be disposed of are properly and hermetically inserted into the tube of flexible material.

In accordance with the invention, this object is achieved in an apparatus for packaging objects to be disposed of into pouches formed along a tube of plastic material, which apparatus comprises:

- a container having an upper portion with an opening having a vertical axis, and a lower portion;
- a ring-shaped cassette mounted into the upper portion of the container coaxially with the opening, the cassette storing the tube of flexible plastic material in a compacted form and allowing it to be pulled from the cassette and moved towards the lower portion of the container in order to receive and store the objects to be disposed of which are inserted into the opening in the upper portion of the container;
- a receiving area located below the opening and the cassette in the upper portion of the container, for receiving the objects to be inserted into the tube; and
- a plunging device mounted onto the upper portion of the container for forcing the objects and a portion of the tube beyond the receiving area into the lower portion of the container.

The above-mentioned plunging device comprises two opposite arms mounted laterally inside the container. These arms each have a top and a bottom portion and they are adapted to move upwardly and downwardly along a predetermined course.

The plunging device also comprises two opposite flaps pivotably attached to the bottom of the arms. These flaps are orthogonal to the arms and each biased towards each other by at least one spring. The flaps also have interlocking edges abutting each other in a horizontal transverse manner relative to the arms. These flaps are opened when the objects are inserted into the opening and manually pushed down.

The plunging device further comprises a pair of opposite slides, orthogonal to the arms and external to the flaps. Each slide has a top portion and a bottom portion attached to each other by a pivot allowing the bottom portions to move towards and away from each other. The pivot lies in a horizontal transverse axis relative to the arms. The bottom portions of the slides are biased towards each other by at least one spring and comprise an interlocking means, which form a hermetic seal and abut in a parallel manner to the interlocking edges of the flaps.

In use, the bottom portions of the slides are kept away from each other by the bottom portion of the arms when the arms are moved upwardly or downwardly between the pivot and the bottom portions of the slides. The bottom portion of the slides are also forced together and thus prevent objects from going beyond the interlocking means of the slides when the bottom portion of the arms are at a position higher than the pivot of the slides.

Preferably, the two arms of the apparatus according to the invention are joined together at their top by a handle. Preferably also, a cover is provided on top of the container to close the opening. The cover may be spring-loaded for automatically opening and thus giving access to the opening. In such a case, the cover is kept closed when the arms of the plunging device are moved down within the container and, it gradually opens when the arms are lifted.

As it can be appreciated, the user of the apparatus according to the invention as disclosed hereinabove can place with one hand only the object to be disposed of beyond the flaps, but not beyond the slides which are kept closed by the arms. Then, the user may remove his or her hand and push the arms down to compress the object between the flaps and the slides. When the bottom portion of the arms reaches the pivot point, the second portion of the slides gradually opens and the object is then pushed beyond the slides into the plastic tube and into the bottom portion of the container. Then, the flaps get closed. The action of the flaps onto the objects pulls the plastic tube downwardly from the cassette as the object goes down. The object is thus hermetically sealed.

An advantage of the present invention is that if there is no object placed in the receiving area, the tube will not be pulled, as opposed to the prior art, where opening and closing of the arms will pull the tube into the bottom portion of the container, whether or not an object is placed in the tube.

Another advantage of the present invention is that it comprises less moving parts that are susceptible to jamming or breaking.

Furthermore, the apparatus is simpler to assemble and it uses less amount of tube than prior art devices since the length of the plunger, i.e. the distance between the open and closed positions of the apparatus is shorter.

As aforesaid the objects to be used with the present invention are preferably soiled diapers. However, any other object of appropriate size to be disposed of could also be packaged therein.

BRIEF DESCRIPTION OF THE DRAWINGS

The invention and its advantages will be more easily understood after reading the following non-restrictive description of a preferred embodiment thereof, made with reference to the following drawings in which.

DESCRIPTION OF A PREFERRED EMBODIMENT OF THE INVENTION

Figure 1:
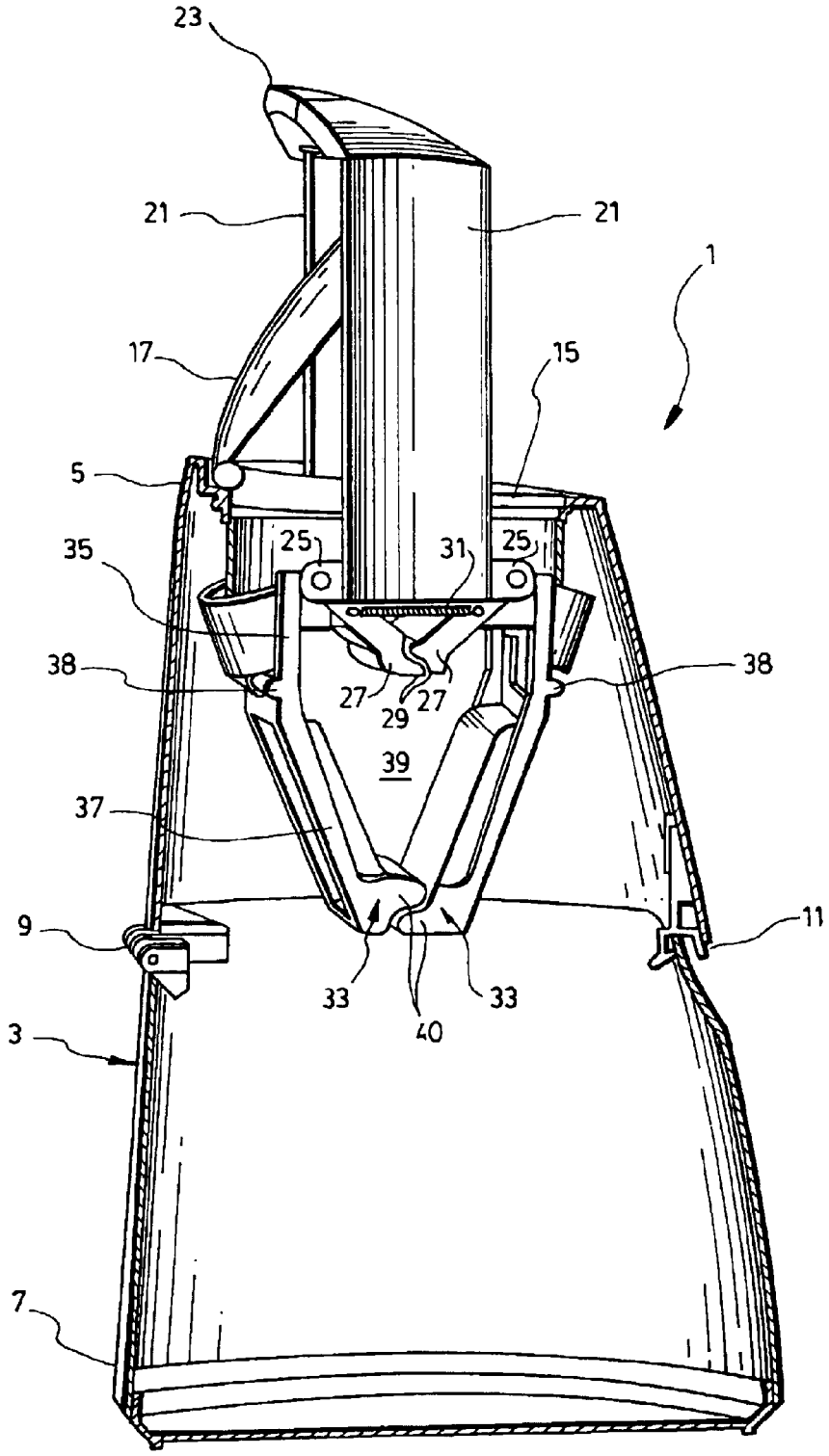
FIG. 1 is a perspective view in cross-section of the apparatus (according to the preferred embodiment of the invention), showing the plunging device, the flaps, the slides and the cover in an open position.

FIGS. 1 to 4 of the drawings illustrate an apparatus according to a preferred embodiment of the invention.

The apparatus 1 includes a container 3 having an upper portion 5 with an opening 15 having a vertical axis, and a lower portion 7. The two portions are connected together with a hinge 9 and can be locked together with a lock 11 located opposite the hinge 9. Preferably, the lock 11 is a child-proof lock, of which many are known to those versed in the art. Also preferably, a cutter (not shown) is placed under the hinge 9 in order to cut the plastic tube where the upper portion 5 of the container 3 is open and the plastic tube is to be disposed of.

At the upper portion 5 of the container 1, there is provided a ring-shaped cassette (not shown in the drawings for clarity). The ring-shaped cassette (not shown) is mounted in the upper portion 5 of the container 1, coaxially with the opening, for storing the tube of flexible plastic material in a compacted form and allowing it to be pulled from the cassette and passed through the same towards the lower portion 7 of the container 1 in order to receive and store the objects to be disposed of while they are inserted into the opening 15 provided for this purpose in the upper portion 5 of the container. For further information on the structure that such a cassette may have, reference can be made to the above mentioned U.S. and Canadian patents. Reference can also be made to U.S. Pat. No. 4,934,529 (RICHARDS et al).

At the top of the container, there is provided a cover 17 to close the opening 15. The cover is preferably spring loaded to open.

The apparatus also includes a plunging device mounted onto the upper portion 5 of the container 3. The plunging device is composed of two opposite arms 21 mounted laterally inside the container 1. Each of the two arms 21 has a top and a bottom portion. The two opposite arms 21 are adapted to move upwardly and downwardly along a predetermined course. Preferably, the two arms 21 are joined together at their respective top ends by a handle 23. Preferably also, the bottom portions of the arms 21 are T-shaped as shown in the Figures, the purpose of which will be explained hereinafter. At the ends of the T-shaped portion 25, holes are provided for receiving pins or pivots 25 of two opposite flaps 27.

The flaps 27 are orthogonal to and pivotably attached to the bottom of the arms. These flaps 27 are inwardly biased towards each other so that at rest, their interlocking edges 29 abut each other in a horizontal transverse manner relative to the arms 21, as shown in FIG. 1. Preferably, the bias is effected with at least one spring 31 secured to each flap 27. Advantageously, two springs 31 are used, one on each side of the flaps 27.

Figure 2:
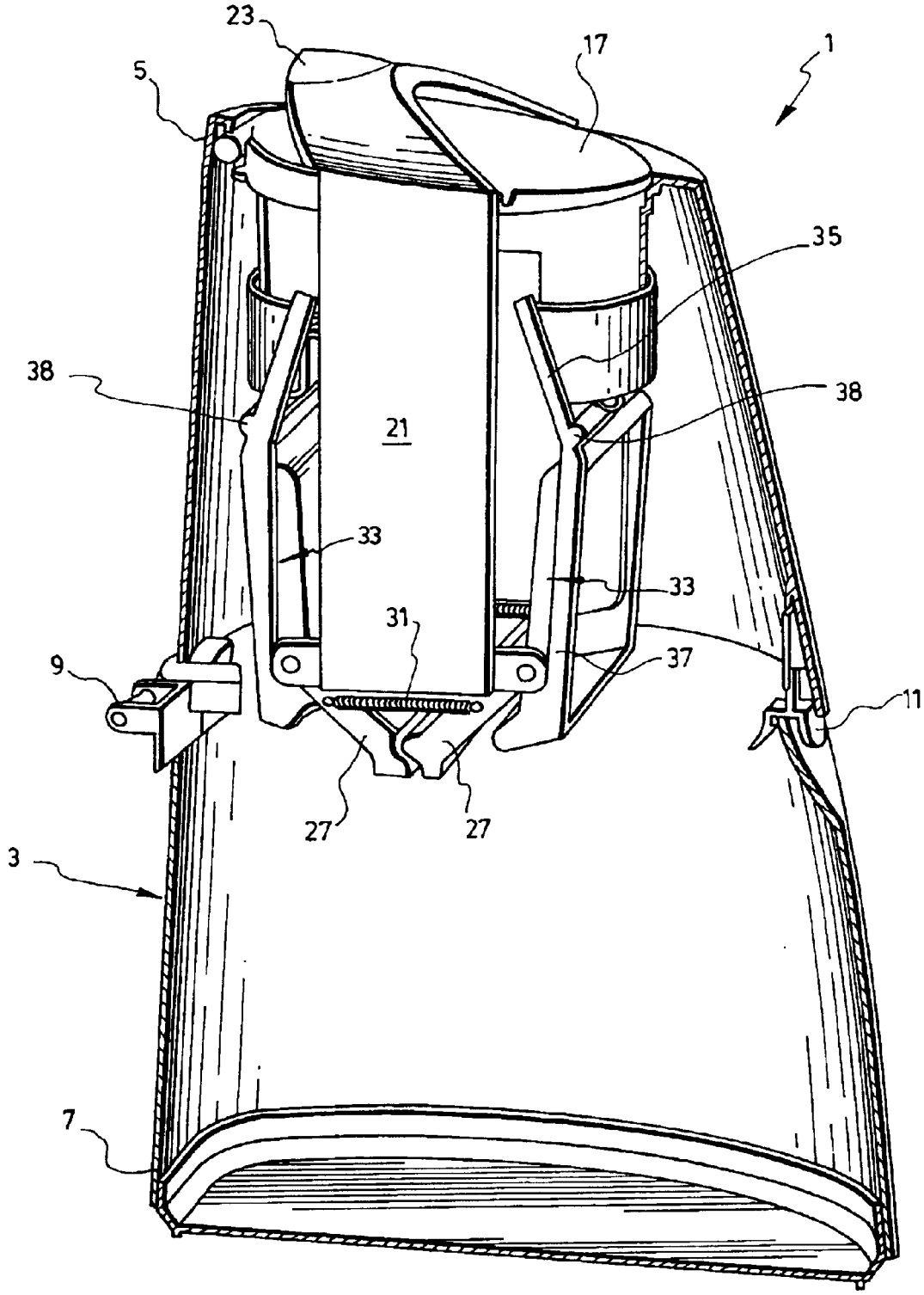
FIG. 2 is a view similar to the one in FIG. 1 of the upper part of the apparatus, showing the plunging device and the cover are in the closed position.
Figure 4:
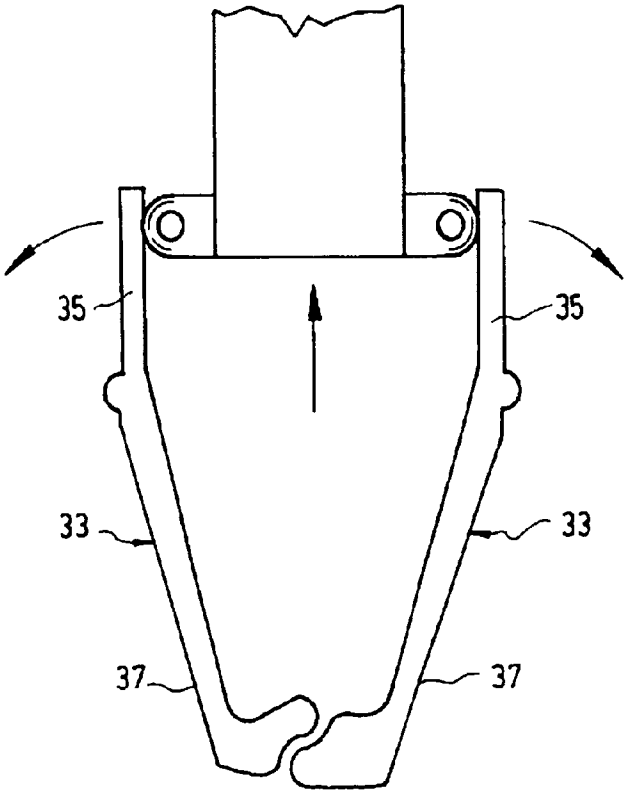
FIG. 4 is a schematic representation of the flaps and slides in the open position.
Figure 3:
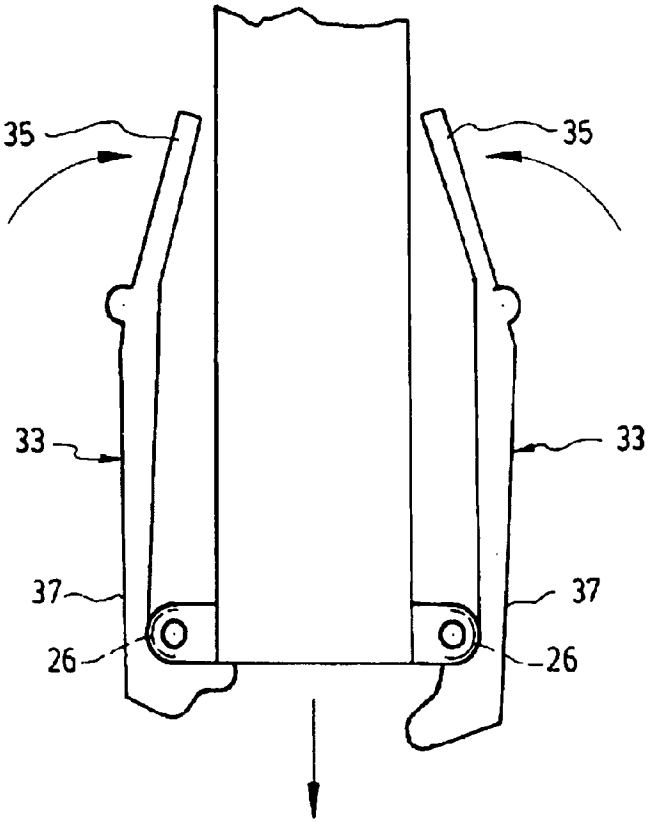
FIG. 3 is a schematic representation of the arms and slides in the closed position.

The plunging device also includes a pair of opposite slides 33. The slides 33 are orthogonal to the arms 21 and external to the flaps 27. Each slide 33 has a top portion 35 and a bottom portion 37 and are attached to the upper portion 5 of the container by a pivot 38 allowing the bottom portions 37 of the slides 33 to move towards and away from each other. The pivot 38 lies in a horizontal transverse axis relative to the arms as shown in FIGS. 1 and 2. The bottom portions of the slides 37 are slightly angled with respect to the top portion of the slides 35, as shown in FIGS. 1 to 4. Each pivot 38 allows the bottom portion 37 of the corresponding slide 33 to pivot towards and away from each other. Preferably, the bottom portions 37 of the slides 33 are provided with co-operating interlocking means 40, as shown in FIG. 1. These interlocking means 40 abut in a parallel manner to the interlocking edges 29 of the flaps to form a hermetic seal.

Preferably also, the slides are biased with at least one spring (not shown) wound about the pivot, whose purpose is to bias the bottom portions 37 of the slides 33 together.

Referring now to FIG. 2, there is shown the apparatus according to a preferred embodiment of the invention, where the apparatus is closed, that is the arms 21 are inserted within the container, and the cover 17 is closed. As can be seen, the T-shaped portions of the arms, as well as a cover or rib 26 for the pivot or pin 25 of the flaps 27, force the slides open.

In other words, the cover 26 forces the second portions 37 of the slides away from each other.

As the handle 23 is lifted, the cover 17 if it is spring loaded, gradually opens, eventually giving access to the opening 15. At the same time, the cover 26 of the arms 21 slides along the edges of the slides 33. As long as the cover 26 is along the second portions 37 of the slides, the slides remain "open". When the cover 17 reaches the pivot 38 point of the slides, the movement along the first sections 35 of the slides 33, as well as the fact that the slides are spring loaded, force the second sections 37 of the slides together, that is to close them.

When the arms 21 are completely slid out, as shown in FIG. 1, the cover 17 is open, and access to the opening 15 is provided. The area between the bottom of the flaps 27 and the bottom portion of the slides 33 is defined as a receiving area 39. The receiving area 39 is located below the opening 15 and the cassette in the upper portion 5 of said container 3.

In use, a user with one hand, places the object to be inserted into the tube beyond the flaps 27, which are being opened when the object is inserted into the opening and is manually pushed down into the receiving area 39. This is easy to do since the flaps 27 are inwardly biased with enough tension to force them together, but not enough to prevent a user from opening them. It should be noted that the user is prevented from pushing the object beyond the slides 33 since they are kept closed by the T-shaped portions of the arms 21 which exert an outward pressure on the first portions 35 of the slides 33.

Once the object is placed into the receiving area 39, the user removes his or her hand, and the flaps 27 close. The user then grips the handle 23 and pushes downwardly. The downward movement along the first portion 35 of the slides compresses the object between the flaps 27 and the slides 33 thereby removing any excess air. When the T-shaped portions of the arms 21 reach the pivot 38 point of the slides 33, the second portions 37 of the slides 33 gradually open. The object is then pushed beyond the slides 33 and into the bottom portion 7 of the container 3. The fact that the flaps 27 are closed and act on the object as it moves down pulls the tube from the cassette (not shown) downwardly. The object is thus hermetically sealed into the tube located at the bottom portion of the container.

When the bottom portion of the container cannot contain any more objects, the user opens the container by opening the child proof lock 11 and pivoting the top portion 5. The user cuts the tube at a portion underneath the slides 33, ties the tube and disposes of it accordingly. The user also ties a knot at the now open end of the tube. The user then closes the container 3, and it is ready for use again.

The apparatus according to the invention is an improvement over the prior art, and notably Canadian patent application n. 2,383,799, in that there are less moving parts that are susceptible to jamming or breaking. Furthermore, assembly of the apparatus is simpler. Finally, the apparatus uses less tube than prior art devices since the length of the plunger, i.e. the distance between the open and the closed positions of the apparatus, is shorter.

Another advantage of the invention is that if there are no objects placed in the receiving area, the tube will not be pulled, as opposed to the prior art, where opening and closing of the arms will pull the tube into the bottom portion of the container, whether or not an object is placed in the tube.

As aforesaid the objects to be used with the present invention are preferably soiled diapers. However, any other object of appropriate size to be disposed of could also be packaged therein.

Although the present invention has been explained hereinabove by way of a preferred embodiment thereof, it should be pointed out that any modifications to this preferred embodiment within the scope of the appended claims is not deemed to alter or change the nature and scope of the present invention.

What is claimed is:

1. An apparatus for packaging objects to be disposed of into pouches formed along a tube of plastic material, said apparatus comprising:

a container having an upper portion with an opening having a vertical axis, and a lower portion;

a ring-shaped cassette mounted into the upper portion of the container coaxially with the opening, said cassette storing the tube of flexible plastic material in a compacted form and allowing it to be pulled from the cassette and moved towards the lower portion of the container in order to receive and store the objects to be disposed of which are inserted into the opening in the upper portion of the container;

a receiving area located below the opening and the cassette in the upper portion of said container, for receiving the objects to be inserted into the tube; and a plunging device mounted onto the upper portion of said container, for forcing said objects and a portion of said tube beyond said receiving area into the lower portion of said container, wherein said plunging device comprises:

two opposite arms mounted laterally inside the container, said arms each having a top and a bottom portion and being adapted to move upwardly and downwardly along a predetermined course;

two opposite flaps pivotably attached to the bottom of the arms, said flaps being orthogonal to the arms and each biased towards each other by at least one spring, said flaps also having interlocking edges abutting each other in a horizontal transverse manner relative to the arms, said flaps being opened when the objects are inserted into the opening and manually pushed down; and a pair of opposite slides, said slides being orthogonal to the arms and external to the flaps and each having a top portion and a bottom portion attached to said upper portion of said container a pivot allowing the bottom portions of the slides to move towards and away from each other, said pivot lying in a horizontal transverse axis relative to the arms, the bottom portions of said slides being biased towards each other by at least one spring and comprising an interlocking means, said interlocking means forming a hermetic seal and abutting in a parallel manner to the interlocking edges of the flaps, the bottom portions of said slides being kept away from each other by the bottom portion of the arms when said arms are moved upwardly or downwardly between the pivot and the bottom portions of the slides, said bottom portion of the slides being forced together to close and thus prevent objects from going beyond the interlocking means of the slides when the bottom portion of the arms are at a position higher than the pivot of the slides.

2. The apparatus according to claim 1 wherein the two arms have their top ends joined together by a handle.

3. The apparatus according to claim 2 wherein a cover is provided on top of the container to close the opening.

4. The apparatus according to claim 3 wherein the top and the bottom portions of the container are connected together with a hinge and wherein a lock is located opposite the hinge to lock said top and bottom portions.

5. The apparatus according to claim 4 wherein the cover is spring-loaded for automatically opening and thus giving access to the opening, said cover being kept closed when the arms of the plunging device are moved down within the container, said cover gradually opening when the arms are lifted.

6. The apparatus according to claim 3 wherein the lock is a child-proof lock.

7. The apparatus according to claim 3 wherein the cover is spring loaded for automatically opening and thus giving access to the opening, said cover being kept closed when the arms of the plunging device are moved down within the container, said cover gradually opening when the arms are lifted.

8. The apparatus according to claim 1 wherein a cover is provided on top of the container to close the opening.

9. The apparatus according to claim 8 wherein the cover is spring-loaded for automatically opening and thus giving access to the opening, said cover being kept closed when the arms of the plunging device are moved down within the container, said cover gradually opening when the arms are lifted.

10. The apparatus according to claim 1 wherein the arms of the plunging device have their bottom ends that are T-shaped.

11. The apparatus according to claim 1 wherein the top and the bottom portions of the container are connected together with a hinge.

12. The apparatus according to claim 11 wherein the container comprises a lock located opposite the hinge to lock its top and bottom portions.

13. The apparatus according to claim 12 wherein the lock is a child-proof lock.

14. The apparatus according to claim 11, further comprising a cutter placed inside the container under the hinge in order to cut the plastic tube when the top portion of the container is open and said plastic tube is to be disposed of.

15. The apparatus according to claim 1 wherein the flaps are biased by two springs, one on each side of the flaps.

16. The apparatus according to claim 1 wherein the bottom portion of each slide is biased with more than one spring wound about the pivot.

17. The apparatus according to claim 1, in which the objects to be disposed of are waste material.

18. The apparatus according to claim 1, in which the objects to be disposed of are disposable diapers.

* * * * *